US007587971B2

(12) United States Patent
Kriegsmann

(10) Patent No.: US 7,587,971 B2
(45) **Date of Patent: *Sep. 15, 2009**

(54) PNEUMATIC ACTUATOR FOR PRECISION SERVO TYPE APPLICATIONS

(75) Inventor: Michael K. Kriegsmann, Glen Ellyn, IL (US)

(73) Assignee: Sunstream Scientific, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/085,665

(22) Filed: Mar. 21, 2005

(65) Prior Publication Data

US 2005/0223888 A1 Oct. 13, 2005

Related U.S. Application Data

(60) Provisional application No. 60/554,441, filed on Mar. 19, 2004.

(51) Int. Cl.
*F01B 29/00* (2006.01)

(52) U.S. Cl. ..... 92/88; 92/85 R

(58) Field of Classification Search ..... 92/88, 92/137, 255, 85 R; 91/228
See application file for complete search history.

(56) References Cited

U.S. PATENT DOCUMENTS

| | | | | |
|---|---|---|---|---|
| 1,206,966 | A | 12/1916 | Wilkins | |
| 2,089,202 | A * | 8/1937 | Gartin | 92/20 |
| 2,146,213 | A * | 2/1939 | Horton | 60/396 |
| 2,147,150 | A * | 2/1939 | Forman et al. | 91/220 |
| 2,761,425 | A | 9/1956 | Bertsch, et al. | |
| 2,977,764 | A * | 4/1961 | Matthews | 60/472 |
| 3,783,590 | A | 1/1974 | Allen | |
| 3,820,446 | A * | 6/1974 | Granbom et al. | 92/88 |
| 4,406,215 | A * | 9/1983 | Lacasse | 92/85 R |
| 4,735,047 | A * | 4/1988 | Wiedmann | 60/415 |
| 4,798,128 | A | 1/1989 | Mita | |
| 4,825,746 | A * | 5/1989 | Herner | 91/45 |
| 5,540,136 | A * | 7/1996 | Noord | 91/224 |
| 5,587,536 | A | 12/1996 | Rasmussen | |
| 6,044,752 | A | 4/2000 | Harigaya | |
| 6,186,484 | B1 * | 2/2001 | Noda et al. | 267/136 |
| 6,523,451 | B1 * | 2/2003 | Liao et al. | 91/363 R |
| 6,523,523 | B2 | 2/2003 | McCoy et al. | |
| 6,553,892 | B1 * | 4/2003 | Kaneko | 92/88 |
| 6,694,865 | B2 * | 2/2004 | Kaneko et al. | 92/88 |

FOREIGN PATENT DOCUMENTS

WO WO 03/10684 A1 12/2003

* cited by examiner

*Primary Examiner*—Hoang M Nguyen
(74) *Attorney, Agent, or Firm*—K & L Gates

(57) ABSTRACT

A pneumatic cylinder designed to convert compressed air into mechanical output is disclosed. A piston assembly, sealed at both end by caps, contains and guides the motion of a piston assembly. Pressure forces on the piston assembly are transmitted via a mechanical structure that distends via a slot that runs the length of the piston assembly. A flexible steel band, which passes through the piston assembly, seals the slot to minimize air leakage. An air control device, such as a servo valve, is operatively coupled to the piston assembly and travels with the piston assembly when a differential pressure is produced on the piston assembly. This arrangement results in a dynamic relationship between airflow and differential pressure that is conducive to precision force and motion control. In addition, the end caps may include snubbers to diffuse sound waves associated with air moving in the piston assembly of the pneumatic cylinder.

17 Claims, 9 Drawing Sheets

⊙ Indicates flow of air into page

Arrows refer to flow of air during an extension

PNEUMATIC ACTUATOR FOR PRECISION SERVO TYPE APPLICATIONS

RELATED APPLICATIONS

This application claims the benefit of U.S. Provisional Application No. 60/554,441, filed Mar. 19, 2004 entitled "Rodless Pneumatic Actuator for Precision Servo Type Applications" which is incorporated herein by reference.

FIELD

The present disclosure relates to pneumatic cylinders and, more particularly, to pneumatic cylinders with reduced acoustical vibration.

BACKGROUND

Conventional pneumatic cylinders provide a conduit for airflow into and out of two working volumes by means of ports machined into the respective end caps. These ports serve as anchor points for plumbing that then communicates airflow to a control valve or valve network. While such an arrangement has a certain level of operability, it typically creates a poor dynamic relationship between airflow and differential pressure. More specifically, such arrangements typically produce excess noise (i.e., acoustical vibrations) in the air column used to move the piston. This noise affects the precise movement of the piston of the pneumatic cylinder. Consequently, attempts to apply such devices in precision applications have met with limited success.

An inherent disadvantage of this construction lies in the fact that the distance between each piston face and its respective air port changes as the piston slews within the cylinder bore. Therefore, the time required for a shock wave emanating from an air port to effect a force change on the piston is dependant on the position of the piston in the bore. Furthermore, shock waves that propagate longitudinally along the cylinder bore may be reflected off either end cap or either piston face. This phenomenon has the potential to create undesirable acoustical characteristics.

SUMMARY

The pneumatic cylinder disclosed herein provides a unique way to communicate airflow between a control valve and the working volumes of the pneumatic cylinder. A piston assembly, sealed at both ends by caps, contains and guides the motion of a piston assembly. Pressure forces on the piston assembly are transmitted via a mechanical structure that distends via a slot that runs the length of the piston assembly. A flexible steel band, which passes through the piston assembly, seals the slot to reduce air leakage.

An air control device, such as a servo valve, is operatively coupled to the piston assembly and travels with the piston assembly when a differential pressure is produced on the piston assembly. This arrangement results in a dynamic relationship between airflow and differential pressure that is conducive to precision force and motion control. In addition, the end caps may include snubbers to diffuse sound waves associated with air moving in the piston assembly. These improvements to the cylinder's acoustics allow for greater controllability in precision servo type applications.

DETAILED DESCRIPTION OF EXEMPLARY EMBODIMENTS

Figure 1:
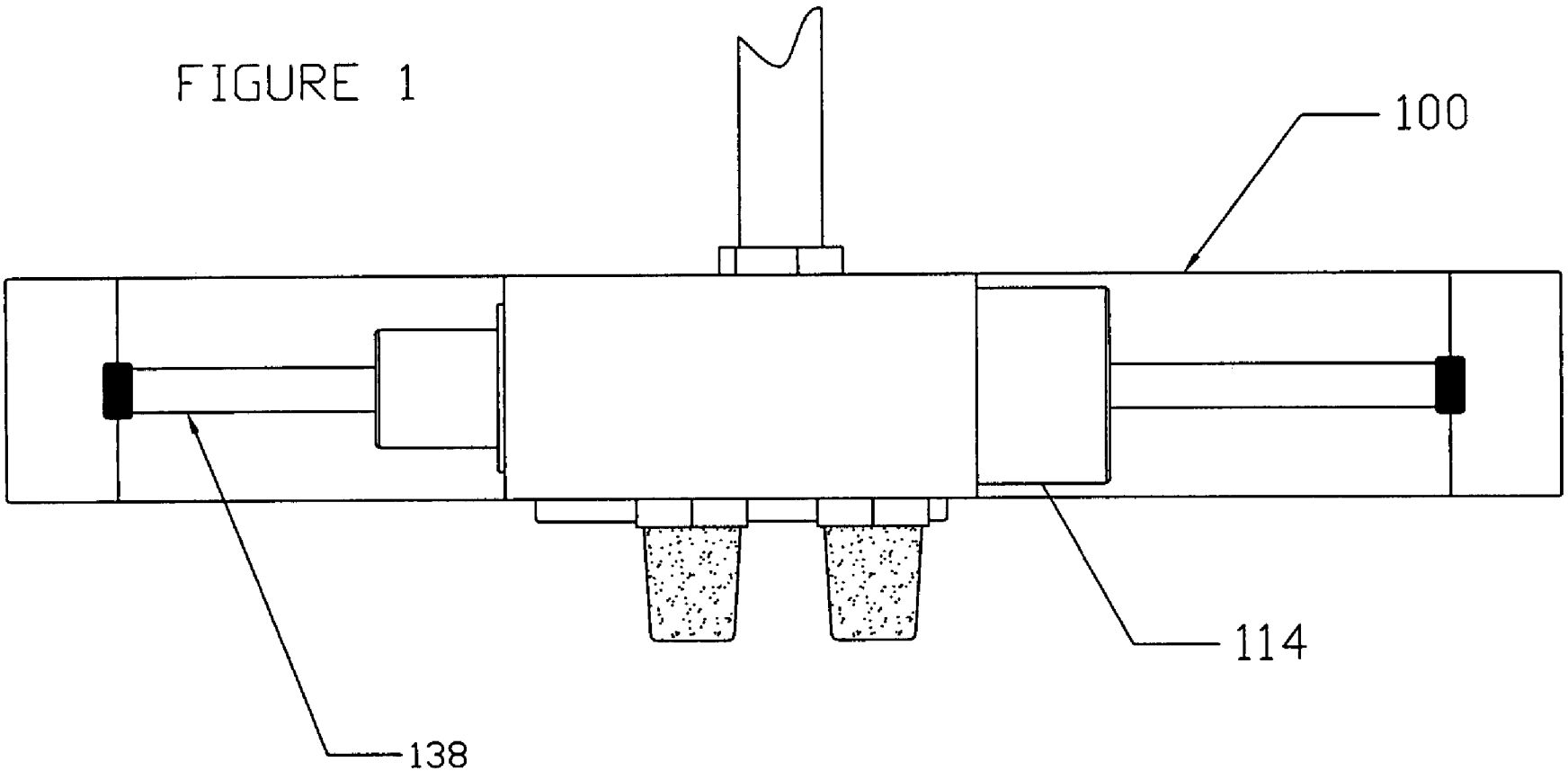
FIG. 1 is a side view of a pneumatic cylinder designed to convert compressed air into mechanical output.
Figure 2:
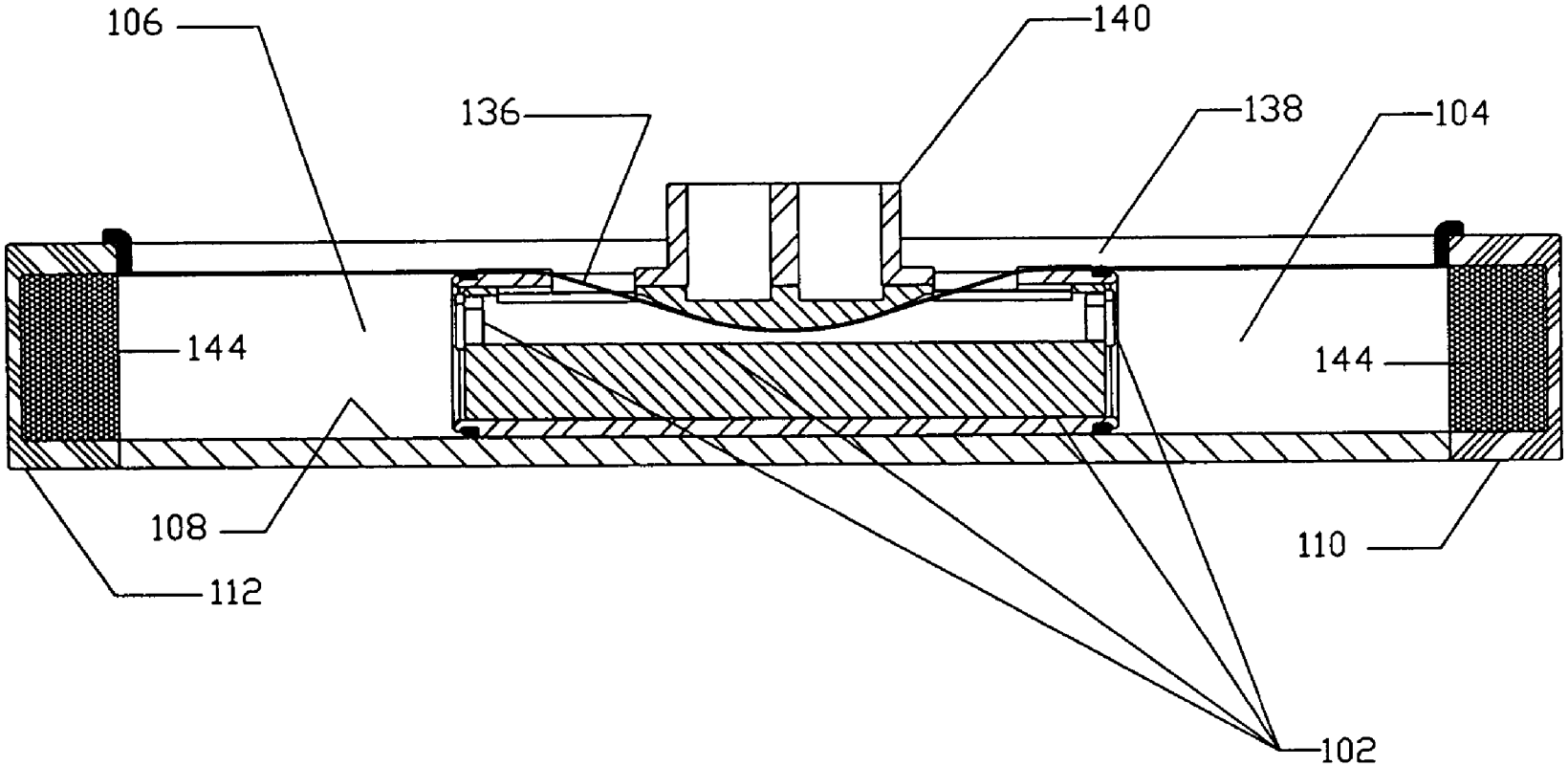
FIG. 2 is a cross-sectional view of an example pneumatic cylinder with absorptive type acoustic snubbers in the end caps.
Figure 3:
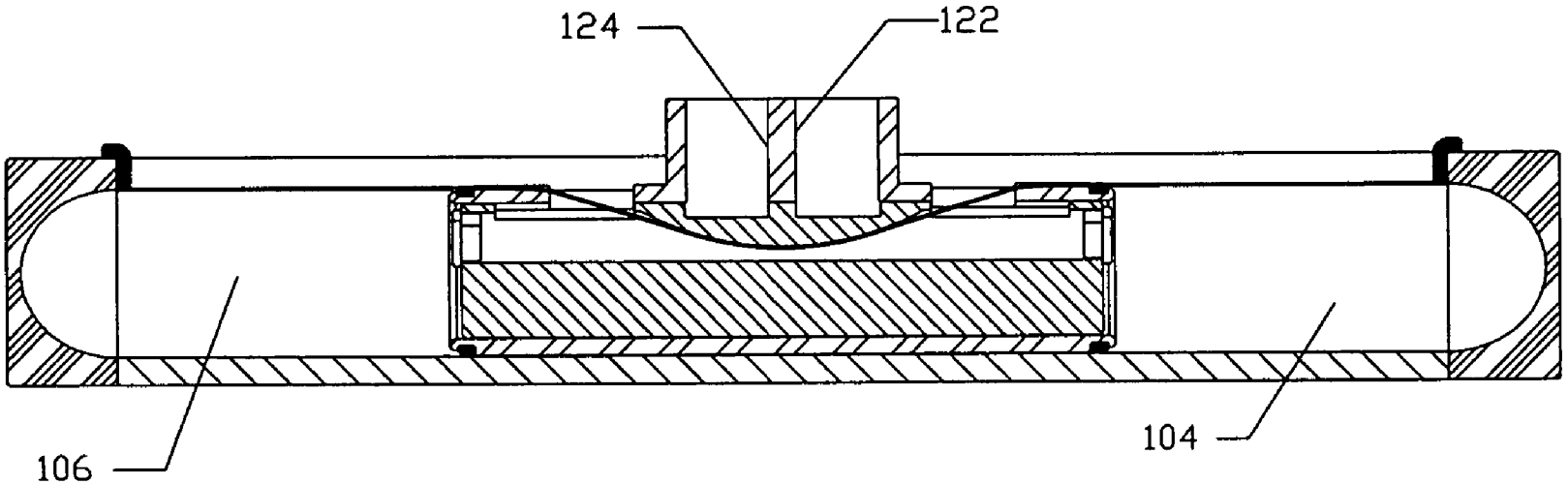
FIG. 3 is a cross-sectional view of an example pneumatic cylinder with dispersion type acoustic snubbers in the end caps.
Figure 4:
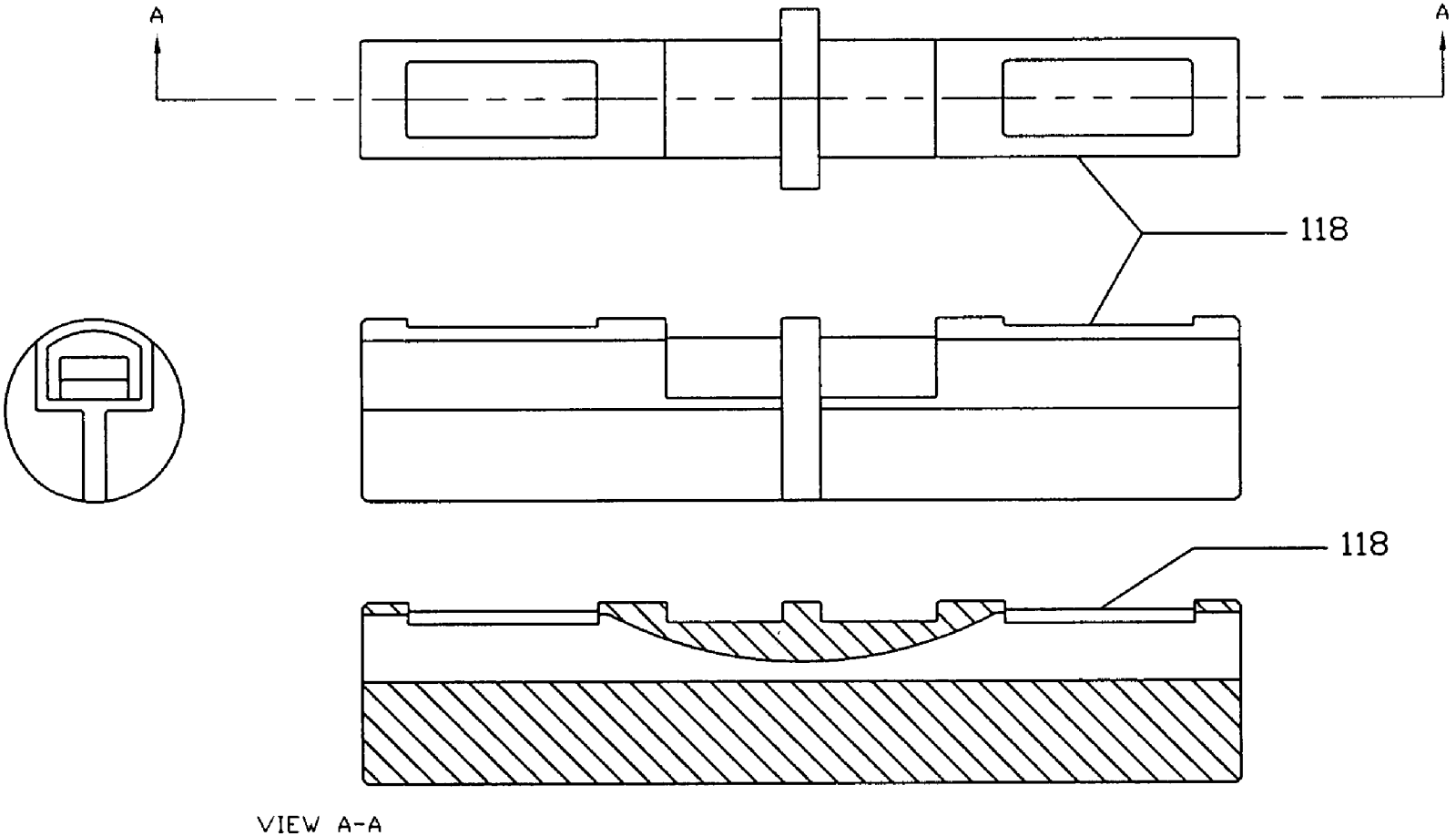
FIG. 4 is an orthogonal view of an example piston insert.
Figure 5:
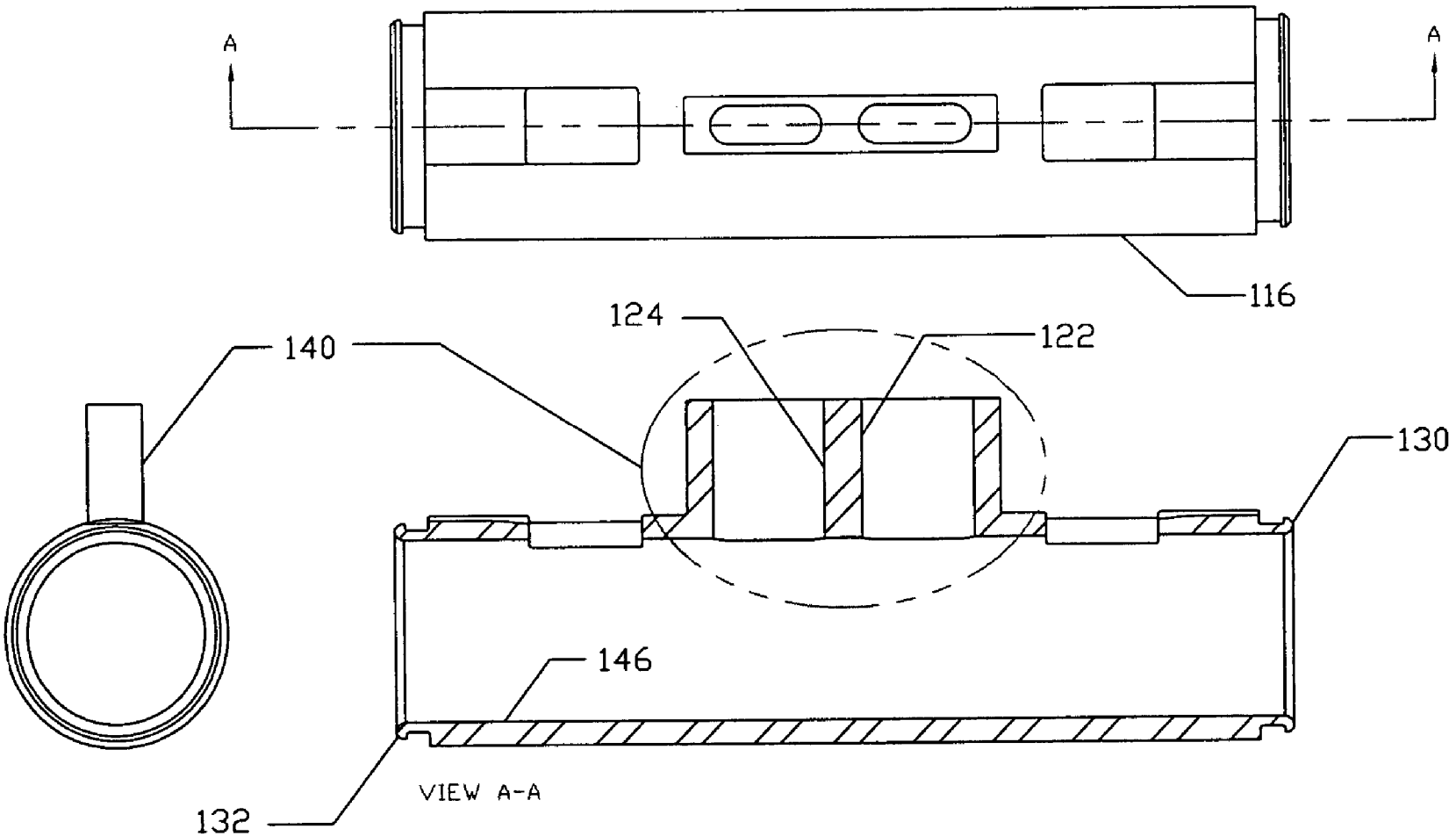
FIG. 5 is an orthogonal view of an example piston shell.
Figure 6:
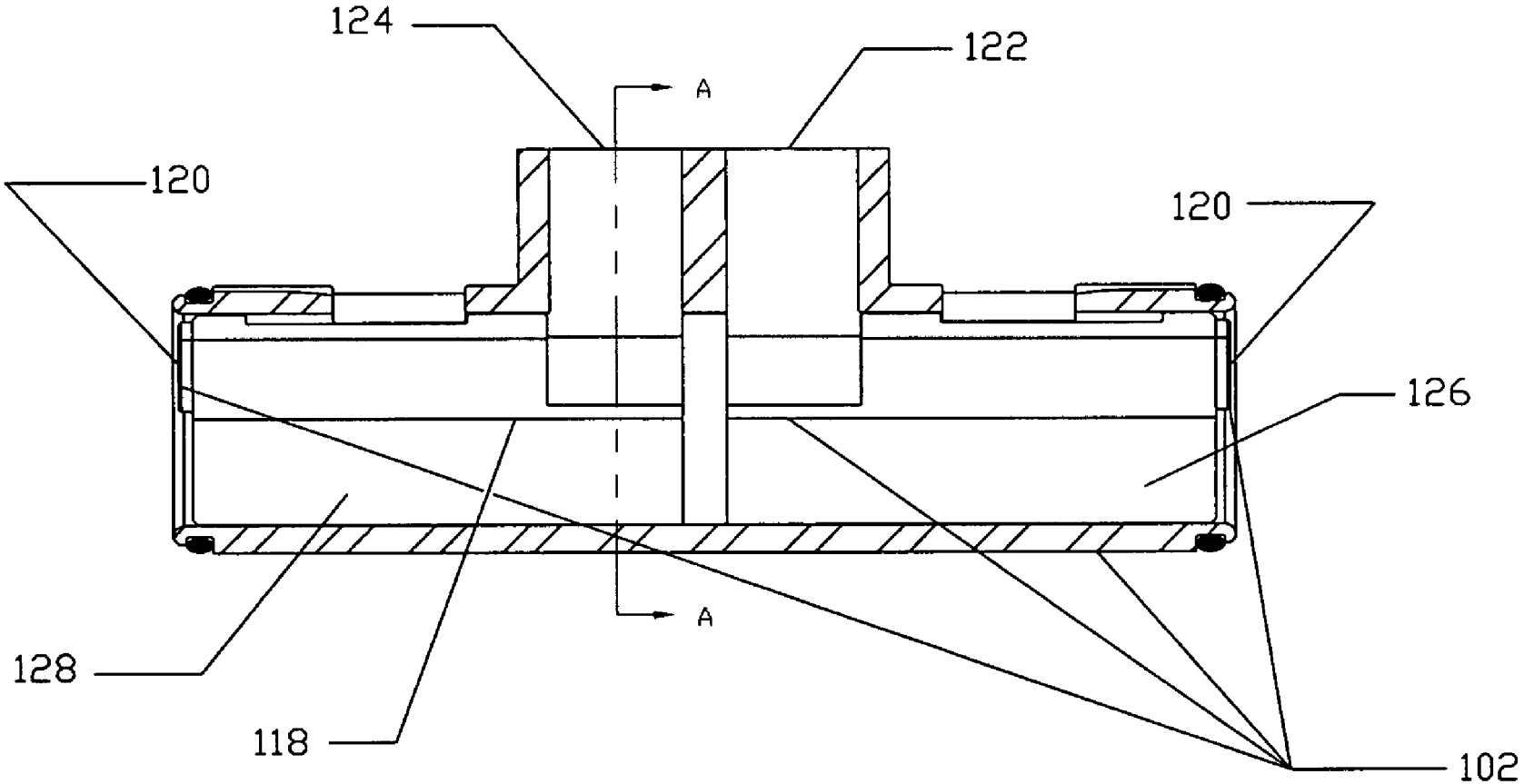
FIG. 6 is a cross-sectional view of an example piston shell including a piston insert and piston plugs.
Figure 7:
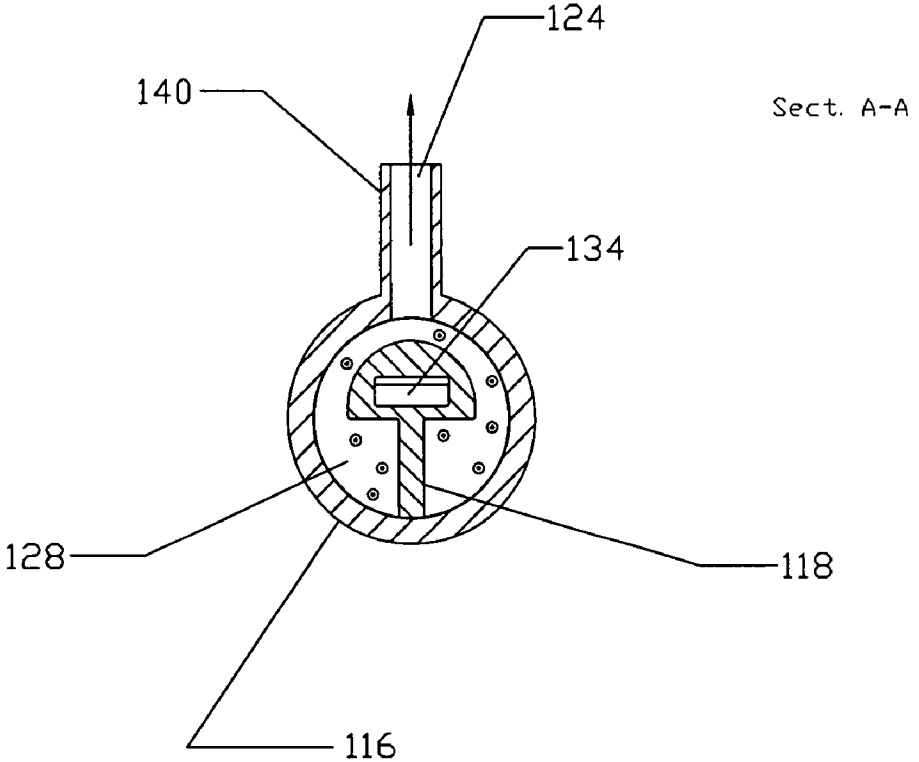
FIG. 7 is a cross-sectional view of an example piston shell showing the path of airflow during an extension of the piston assembly.

A pneumatic cylinder 100 designed to convert compressed air into mechanical output is illustrated in FIGS. 1–9. Although a rodless pneumatic actuator is illustrated, any suitable type of pneumatic actuator may be used (e.g., with a rod connected to the piston). Differential pressure across a piston assembly 102 produces a force that can extend (e.g., left on the page) the piston assembly 102, or cause the piston assembly 102 to retract (e.g., right on the page). The differential pressure is the difference in air pressure between a first working volume 104 and a second working volume 106.

The first working volume 104 is the cylindrical chamber created by the piston assembly 102, a cylinder bore 108, and a first end cap 110. The second working volume 106 is cylindrical chamber created by the piston assembly 102, the cylinder bore 108, and a second end cap 112. The cylinder bore 108 also serves to guide the piston assembly 102. It should be noted that the air pressure in each working volume 104 and 106 is not necessarily uniform, and that variations over space for any specific point in time are to be expected. In addition, although cylindrical shapes are discussed in the exemplary embodiment herein, it will be readily recognized that any suitable shape(s) may be used.

Air pressure in each working volume 104 and 106 can be altered in any suitable manner. For example, the mass of air contained within a working volume 104 and/or 106 can be changed by allowing air to flow into or out of the working volume 104 and/or 106. During an extension, air flows into the first working volume 104, thus increasing pressure in the first working volume 104. Also during an extension, air flows out of the second working volume 106, thus decreasing pressure in the second working volume 106. Preferably, a pneumatic control valve 114 is used to control the communication of airflow into and out of the working volumes 104 and 106. The pneumatic control valve 114 is capable of directing compressed air into one of the working volumes 104 or 106, and conversely, discharging compressed air out of the other working volume 106 or 104 (e.g., to atmosphere).

The piston assembly 102 includes a piston shell 116, a piston insert 118, and a pair of piston plugs 120. Airflow communication between each working volume 104 and 106 and its respective air port 122 and 124 is directed through the piston assembly 102 by way of dual channels formed by the piston shell 116 and the piston insert 118. The piston insert 118 divides the bore 146 of the piston shell 116 into a first piston chamber 126 exposed to the first working volume 104 and a second piston chamber 128 exposed to the second working volume 106.

The annular area created by the inner diameter and the outer diameter of the piston shell 116 defines a first piston face 130 and a second piston face 132. Pressure in the first working volume 104 is integrated over the surfaces in the first piston chamber 126 and over the first piston face 130 to create a force that extends the piston assembly 102. Pressure in the second working volume 106 is integrated over the surfaces in second piston chamber 128 and over the second piston face 132 to create a force that retracts the piston assembly 102.

The piston insert 118 and the piston plugs 120 create a channel 134 nested within the piston shell 116. The channel 134 allows a flexible steel band 136 to pass between the first working volume 104 and the second working volume 106 while keeping both working volumes 104 and 106 isolated from one another. The flexible steel band 136 seals a slot 138 that runs the length of the cylinder 100. A neck 140 of the piston shell 116 extends through the slot 138. The piston shell 116 and piston insert 118 are preferably bonded together by a process such as brazing before being integrated into the pneumatic cylinder 100.

During an extension of the piston assembly 102, the air control device 114 (e.g., servo valve) directs air from a compressed air source through the first air port 122 into the first piston chamber 126. The air then moves out through an opening in the piston shell 116 into the first working volume 104. Conversely, air flows from the second working volume 106 into the second piston chamber 128 and then out through the second air port 124 before being discharged via the air control device 114 to atmosphere.

Figure 8:
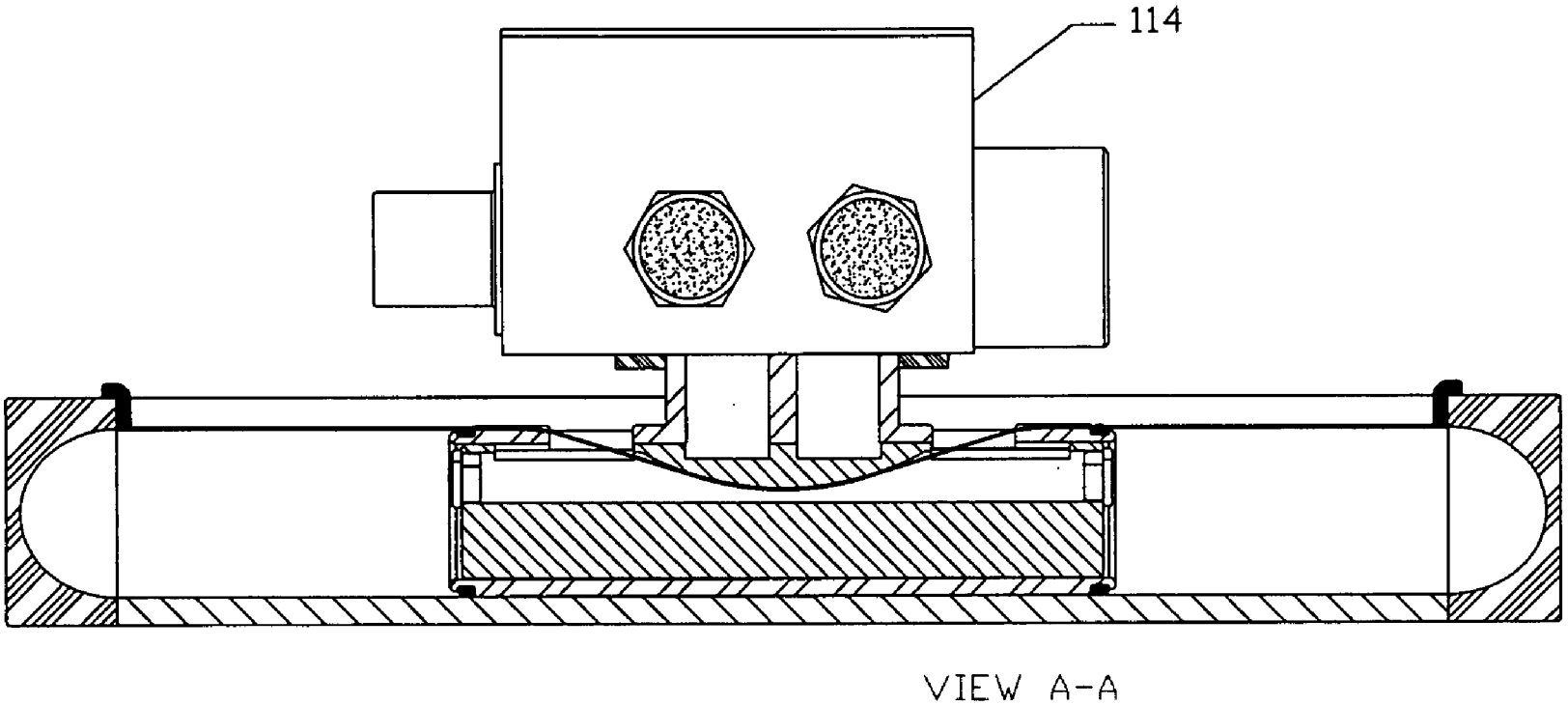
FIG. 8 is a cross-sectional view of an example cylinder body showing a servo valve coupled to the piston assembly.
Figure 9:
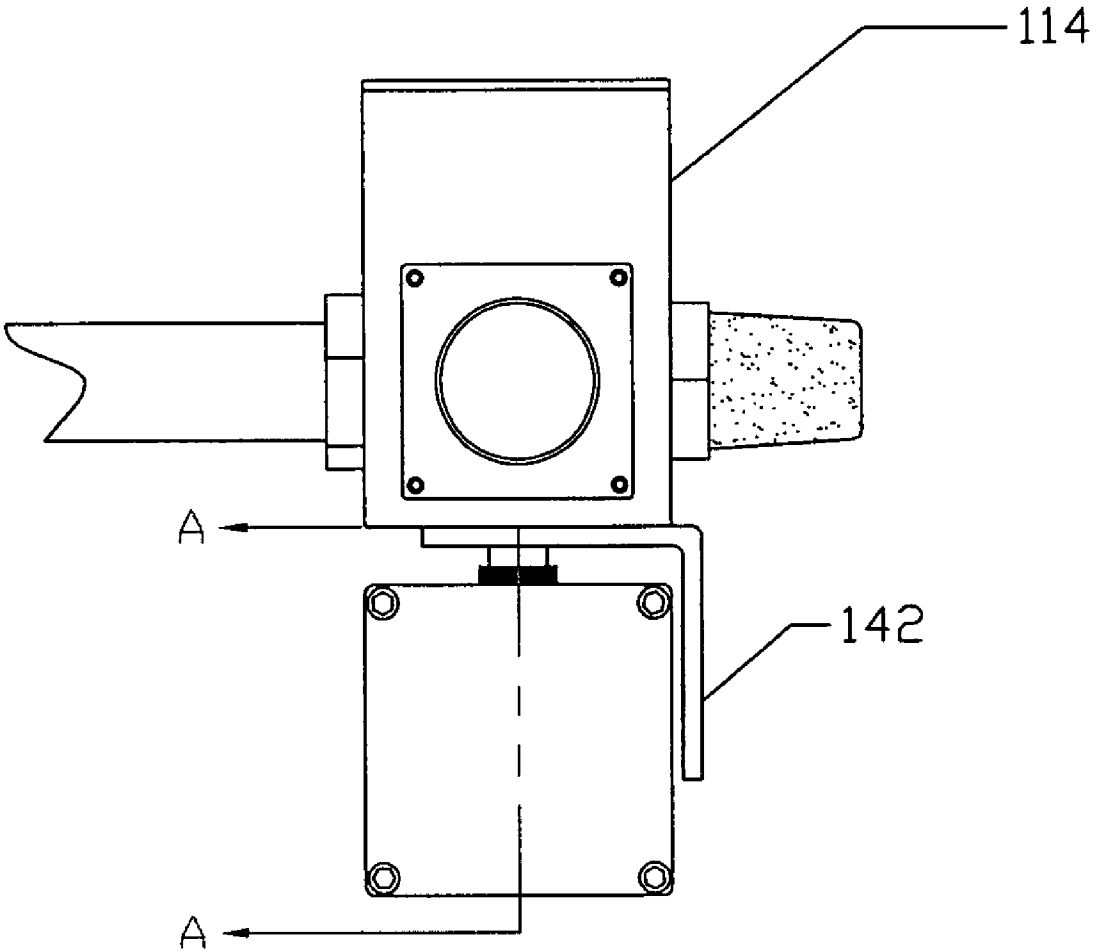
FIG. 9 is a side view of an example pneumatic cylinder showing a mounting bracket coupled to the neck of the piston assembly.

An example of an air control device 114 is shown mechanically coupled to the neck 140 of the piston shell 116 in FIGS. 8 and 9. In one embodiment, the air control device 114 is mounted to the neck 140 of the piston shell 116 via a shock absorbing material such as rubber or foam. The air ports 122 and 124 of the piston assembly 102 engage similar air ports featured in the air control device 114 and seal thereupon. A mounting bracket 142 is mechanically coupled to the neck 140 of the piston shell 116 to transmit the force on the piston assembly 102 to an external load. A pressure sensor and/or an accelerometer may be mounted within the air control device 114. Such a disposition provides for an efficient integration of the sensors with the electronics required to drive the air control device 114 while minimizing delay and distortion.

The air control device 114 travels with the piston assembly 102 when a differential pressure is produced on the piston assembly 102. This arrangement shortens the length a shock wave must travel between each air port 122 and 124 and the corresponding piston faces 130 and 132. By shortening this length, the time required for a shock wave generated by the air control device 114 to effect a force change on the piston assembly 102 is reduced. In addition, this arrangement keeps the length the shock wave must travel between each air port 122 and 124 and the corresponding piston faces 130 and 132 constant regardless of the position of the piston assembly 102 relative to the cylinder end caps 110 and 112.

To further improve the dynamic relationship between airflow and differential pressure, acoustical snubbers 144 may be incorporated into the first end cap 110 and/or the second end cap 112. During operation of the pneumatic cylinder 100, pressure waves may emanate from the piston assembly 102 and travel longitudinally along the length of the cylinder bore 108. In the case of the first working volume 104, the shock waves travel between the piston assembly 102 and the first end cap 110. In the case of the second working volume 106, the shock waves travel between the piston assembly 102 and the second end cap 112. The acoustical snubbers 144 reduce the magnitude of the reflected shock wave. The acoustical snubbers 144 may accomplish this task by dispersing the shock wave, deflecting the shock wave, and/or absorbing the shock wave. Similarly, any chamber and/or channel within the pneumatic cylinder 100 may be lined with any suitable material that absorbs noise.

While the specification and the corresponding drawings reference preferred examples, it should be appreciated that various changes may be made and equivalents may be substituted for elements thereof without departing from the scope of the present invention as set forth in the following appended claims. In addition, many modifications may be made to adapt a particular situation or material to the teachings of the invention, as set forth in the appended claims, without departing from the essential scope thereof. Therefore, it is intended that the present invention not be limited to the particular examples illustrated by the drawings and described in the specification as the best modes presently contemplated for carrying out the present invention, but that the present invention will include any embodiments falling within the description of the appended claims and equivalents thereof.

The invention claimed is:

1. A rodless pneumatic cylinder comprising:

a piston assembly;

a body;

a first aperture and an associated first airflow channel defined in the piston assembly;

a second aperture and an associated second airflow channel defined in the piston assembly;

a working volume defined in the body;

a piston, defined in the piston assembly, and disposed in the working volume to separate the working volume into a first working volume and a second working volume, wherein the piston is arranged to enable a difference in air pressure between the first working volume and the second working volume to produce a differential force on the piston assembly, wherein a first distance from the first aperture to the piston remains constant during a movement of the piston and a second distance from the second aperture to the piston remains constant during the movement of the piston;

a first end cap operatively coupled to the body, the first end cap having an inner planar surface and a cylindrical portion having an inner cylindrical surface, wherein the inner cylindrical surface defines a perimeter of a three dimensional space;

a first acoustical foam snubber operatively coupled to the first end cap, wherein the first acoustical foam snubber fills the three dimensional space, the first acoustical foam snubber having a planar surface area made of foam, wherein the planar surface area made of foam is exposed to the working volume defined in the body, the first acoustical snubber being configured to diffuse a first sound wave associated with air moving in the first working volume when the air contacts the first acoustical snubber; and an air control device operatively coupled to the piston assembly, the air control device being located outside the working volume, the air control device being positioned to travel with the piston assembly when the differential pressure is effected on the piston, the air control device being structured to (a) direct air into the first working volume through the piston assembly via the first aperture, (b) to direct air out of the second working volume through the piston assembly via the second aperture, (c) direct air into the second working volume through the piston assembly via the second aperture, and (d) direct air out of the first working volume through the piston assembly via the first aperture, wherein the active air control device includes a pressure sensor and a servo valve.

2. The pneumatic cylinder of claim 1, wherein the first acoustical foam snubber comprises an element to disperse acoustical energy.

3. The pneumatic cylinder of claim 1, wherein the first acoustical foam snubber comprises an element to deflect acoustical waves.

4. The pneumatic cylinder of claim 1, wherein the first acoustical foam snubber comprises an element to absorb acoustical energy.

5. The pneumatic cylinder of claim 1, further comprising:

a second end cap operatively coupled to the body; and a second acoustical foam snubber operatively coupled to the second end cap, the second acoustical foam snubber to diffuse a second sound wave associated with air moving in the second working volume.

6. The pneumatic cylinder of claim 1, wherein the air control device includes an accelerometer.

7. The pneumatic cylinder of claim 1, wherein the first airflow channel is lined with a noise absorbing material.

8. The pneumatic cylinder of claim 1, wherein a first cross-sectional area associated with the first aperture is substantially equal to a second cross-sectional area associated with the first airflow channel.

9. The pneumatic cylinder of claim 1, wherein the body is an extruded body.

10. A pneumatic cylinder comprising:

a piston assembly;

a body;

a first aperture and an associated first airflow channel defined in the piston assembly;

a second aperture and an associated second airflow channel defined in the piston assembly;

a working volume defined in the body;

a piston, defined in the piston assembly, disposed in the working volume to separate the working volume into a first working volume and a second working volume, wherein the piston is arranged to enable a difference in air pressure between the first working volume and the second working volume to produce a differential force on the piston assembly, wherein a first distance from the first aperture to the piston remains constant during a movement of the piston and a second distance from the second aperture to the piston remains constant during the movement of the piston;

a first end cap operatively coupled to the body, the first end cap having an inner planar surface and a cylindrical portion having an inner cylindrical surface, wherein the inner cylindrical surface defines a perimeter of a three dimensional space;

a first acoustical foam snubber operatively coupled to the first end cap, wherein the first acoustical foam snubber fills the three dimensional space, the first acoustical foam snubber having a planar surface area made of foam, wherein the planar surface area made of foam is exposed to the working volume defined in the body, the first acoustical snubber being configured to diffuse a first sound wave associated with air moving in the first working volume when the air contacts the first acoustical snubber; and an active air control device located outside the working volume, the active air control device being operativelv coupled to the piston assembly, the active air control device traveling with the piston assembly when the differential pressure is effected on the piston, the active air control device actively directing air from a compressed air source through the first aperture into the first working volume, wherein the active air control device includes a pressure sensor and a servo valve.

11. The pneumatic cylinder of claim 10, further comprising:

a second end cap operatively coupled to the body; and a second acoustical foam snubber operatively coupled to the second end cap, the second acoustical foam snubber to diffuse a second sound wave associated with air moving in the second working volume.

12. The pneumatic cylinder of claim 10, wherein the first acoustical foam snubber comprises an element to disperse acoustical energy.

13. The pneumatic cylinder of claim 10, wherein the first acoustical foam snubber comprises an element to deflect acoustical waves.

14. The pneumatic cylinder of claim 10, wherein the first acoustical foam snubber comprises an element to absorb acoustical energy.

15. The pneumatic cylinder of claim 10, wherein the active air control device includes an accelerometer.

16. The pneumatic cylinder of claim 1, wherein the first airflow channel and the second airflow channel are lined with a noise absorbing material.

17. The pneumatic cylinder of claim 10, wherein in the active control device includes a member driven by an electromagnetic device.

* * * * *